US008038330B2

(12) United States Patent
Liu

(10) Patent No.: US 8,038,330 B2
(45) Date of Patent: Oct. 18, 2011

(54) MOVABLE MULTI-DIRECTIONAL LIGHT STAND

(76) Inventor: Yun-Zhao Liu, Zhongshan (CN)

( * ) Notice: Subject to any disclaimer, the term of this patent is extended or adjusted under 35 U.S.C. 154(b) by 324 days.

(21) Appl. No.: 12/458,039

(22) Filed: Jun. 30, 2009

(65) Prior Publication Data

US 2010/0328962 A1 Dec. 30, 2010

(51) Int. Cl.
*F21S 8/08* (2006.01)

(52) U.S. Cl. ..... 362/413; 362/414; 362/418; 362/419; 362/285; 362/287; 362/427; 362/431; 248/125.8; 248/157; 248/161; 248/406.1

(58) Field of Classification Search ..... 362/11, 362/84, 153, 153.1, 188, 190, 191, 197–199, 362/249.01, 249.07–247.09, 249.1, 285, 362/287, 382, 384, 396, 413, 414, 418, 422, 362/424, 425, 427, 430, 431; 248/125.8, 248/157, 161, 405, 406.1, 430
See application file for complete search history.

(56) References Cited

U.S. PATENT DOCUMENTS

| | | | | | |
|---|---|---|---|---|---|
| 1,729,395 | A * | 9/1929 | Mandel | 211/172 |
| 2,473,218 | A * | 6/1949 | Reichenbach | 248/411 |
| 2,636,112 | A * | 4/1953 | Dvorsky | 362/413 |
| 2,740,039 | A * | 3/1956 | Phillips | 362/413 |
| 5,031,085 | A * | 7/1991 | Rustin | 362/401 |
| 5,065,297 | A * | 11/1991 | Santambrogio | 362/413 |
| 5,065,299 | A * | 11/1991 | Cohen | 362/431 |
| 5,141,325 | A * | 8/1992 | Huang | 362/413 |
| 5,169,226 | A * | 12/1992 | Friedman | 362/190 |
| 6,416,207 | B1 * | 7/2002 | Chang | 362/419 |
| 6,644,831 | B2 * | 11/2003 | Simon | 362/640 |
| 6,871,985 | B2 * | 3/2005 | Humphrey | 362/431 |
| 7,021,787 | B1 * | 4/2006 | Kuelbs | 362/183 |
| 7,073,926 | B1 * | 7/2006 | Kremers et al. | 362/419 |
| 7,195,377 | B2 * | 3/2007 | Tsai | 362/431 |
| 7,240,886 | B2 * | 7/2007 | Jones | 248/405 |
| 2004/0104321 | A1 * | 6/2004 | Marsolais et al. | 248/229.1 |
| 2005/0057934 | A1 * | 3/2005 | Chen | 362/413 |
| 2009/0014605 | A1 * | 1/2009 | Kehl | 248/161 |

* cited by examiner

*Primary Examiner* — James Lee
*Assistant Examiner* — Stanley Weinberg
(74) *Attorney, Agent, or Firm* — Rosenberg, Klein & Lee

(57) ABSTRACT

A movable multi-directional light stand is revealed. The movable multi-directional light stand includes a retractable top support rod that can be received into and connected with a hollow middle support rod. The top support rod is disposed with a mounting slot on a wall, along an axial direction thereof. A sleeve with external threads is disposed around the top of the top support rod and is arranged with a guiding slot corresponding to the mounting slot of the top support rod. A retractable light rod is pivoted to the wall of the top support rod that is disposed with the mounting slot. The retractable light rod is formed by a hollow outer tube and an inner tube that slides in the outer tube and having a hook. The light stand further includes an adjustment nut with threads engaging corresponding external threads of the sleeve so that the adjustment nut can support the outer tube, locate the retractable light rod in the mounting slot and adjust the height of the light. Thereby the light stand is retractable and rotatable in a horizontal plane so as to illuminate in different directions.

6 Claims, 10 Drawing Sheets

MOVABLE MULTI-DIRECTIONAL LIGHT STAND

BACKGROUND OF THE INVENTION

1. Fields of the Invention

The present invention relates to a movable multi-directional light stand, especially to an adjustable and retractable light stand that can rotate in a horizontal plane so as to light in different directions.

2. Descriptions of Related Art

Generally, while camping or working outdoors at night, an illumination device is used for lighting. Thus there is a plurality of outdoor illumination device with different designs available now. For example, a fixed floor light is one of them. Such light is inconvenient because it is unable to adjust the height of the light. Thus insufficient light is available or users need to adjust surrounding elements in use. This is extremely inconvenient and annoying for users.

In order to overcome above shortcomings, a foldable light stand is provided. The light stand is composed of a support base, a top support rod, a hollow middle support rod and a light rod disposed on the top support rod. The support base includes three support feet, a connection seat, a central support rod and a movable fastening sleeve. The three support feet are pivoted to the connection seat and the central support rod is assembled with a central hole of the connection seat. The hollow middle support rod is inserted into the central support rod. The central support rod and the middle support rod are assembled and disassembled with each other by a fastening nut. The top support rod is connected with the middle support rod and is able to be received in the middle support rod. The light rod is connected with the top support rod. The disadvantage of above design is in that the light rod is unable to rotate an angle in a plane vertically so that the height of the light is unable to be adjusted. Moreover, the light rod is unable to fold and this is inconvenient for storage.

Thus there is a need to provide a light stand without disadvantages mentioned above while with better lighting effect and higher practice value.

SUMMARY OF THE INVENTION

Therefore it is a primary object of the present invention to provide a movable multi-directional light stand that is adjustable and retractable. At the same time, the light stand can rotate in a horizontal plane so as to light various areas from different directions.

In order to achieve above object, the movable multi-directional light stand includes a retractable top support rod that can be received into and connected with a hollow middle support rod. A mounting slot is disposed on a wall of the top support rod, along an axial direction of the support rod. A sleeve with external threads is disposed around the top of the top support rod and is having a guiding slot corresponding to the mounting slot of the top support rod. A retractable light rod is pivoted to the wall of the top support rod that is disposed with the mounting slot. The retractable light rod consists of a hollow outer tube and an inner tube. The inner tube is having a hook and sliding in the outer tube. An adjustment nut has threads engaging corresponding external threads of the sleeve so as to support the outer tube, locate the retractable light rod in the mounting slot and adjust the height of the light.

The movable multi-directional light stand of the present invention further includes a top head nut with internal threads and a stud on the top of the top head nut. Thus the top head nut is disassembled or assembled with the sleeve by the internal threads engaging with the external threads. The stud matches a screw hole on one end of the top support rod.

The movable multi-directional light stand of the present invention is further disposed with a connection seat that has an axial through hole and external threads for fastening on the upper part thereof. The top end of the middle support inserts into the through hole and the bottom end of the top support rod inserts into the middle support rod. By the fastening nut engaging the external threads for fastening, the middle support rod is connected with and fixed on the connection seat.

In the movable multi-directional light stand of the present invention, a locating hole is disposed on one end of the outer tube of the retractable light rod while the other end thereof is arranged with a locating pin. The inner tube is disposed with a sliding slot for the locating pin of the outer tube to slide therein while a locating pin is arranged at one end of the inner tube that is mounted into the outer tube correspondingly. Thereby, the extension length of the retractable light rod can be adjusted.

Moreover, both the outer tube and the inner tube of the movable multi-directional light stand can be designed into a cone-shaped post so that the inner tube presses and leans against the outer tube tightly by the cone angle while being pulled out.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

Figure 1:
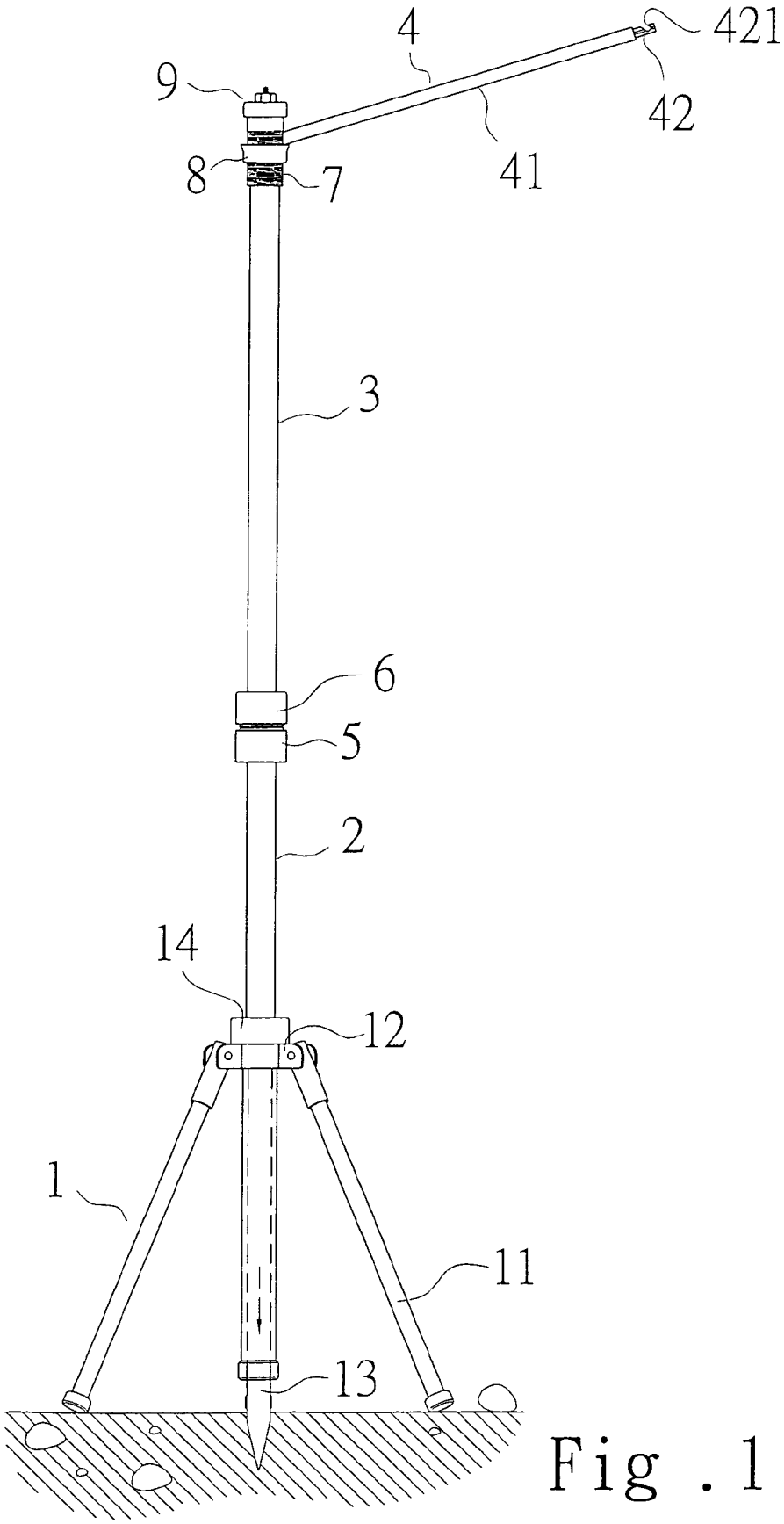
FIG. 1 is a perspective view of an embodiment according to the present invention.
Figure 2:
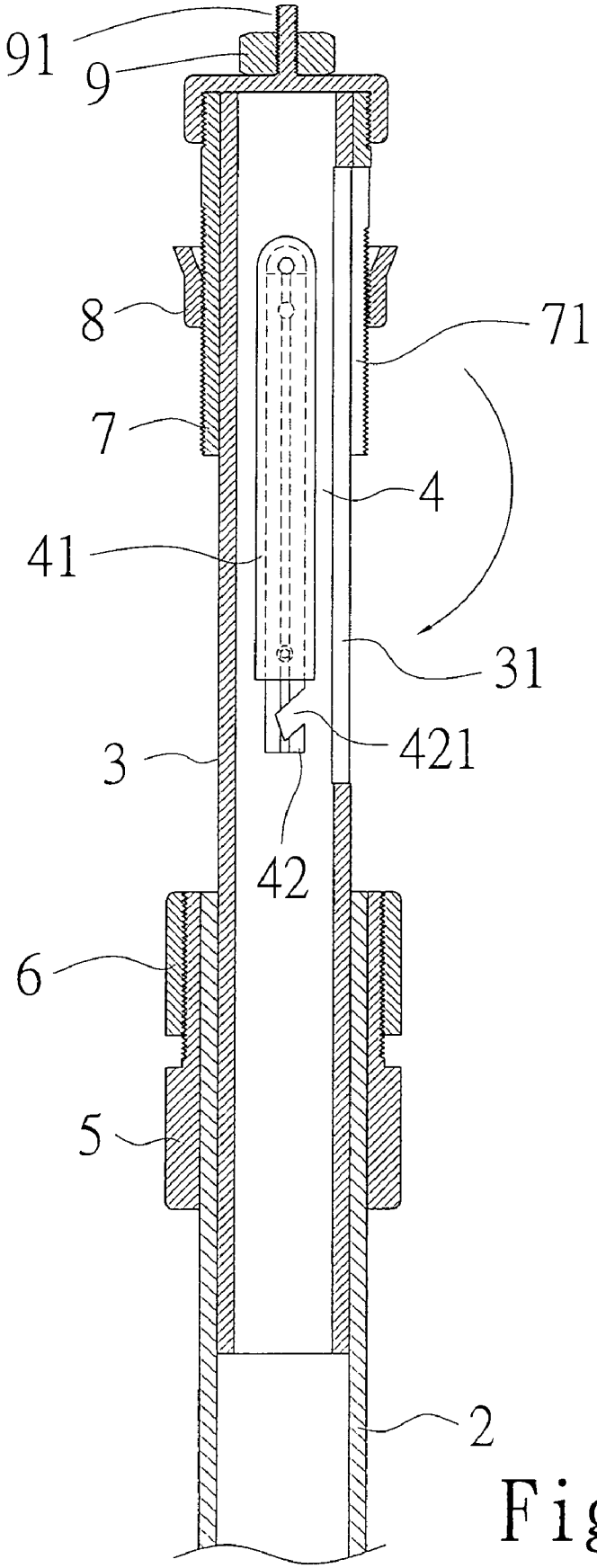
FIG. 2 is a partial cross sectional view of an embodiment according to the present invention.
Figure 3:
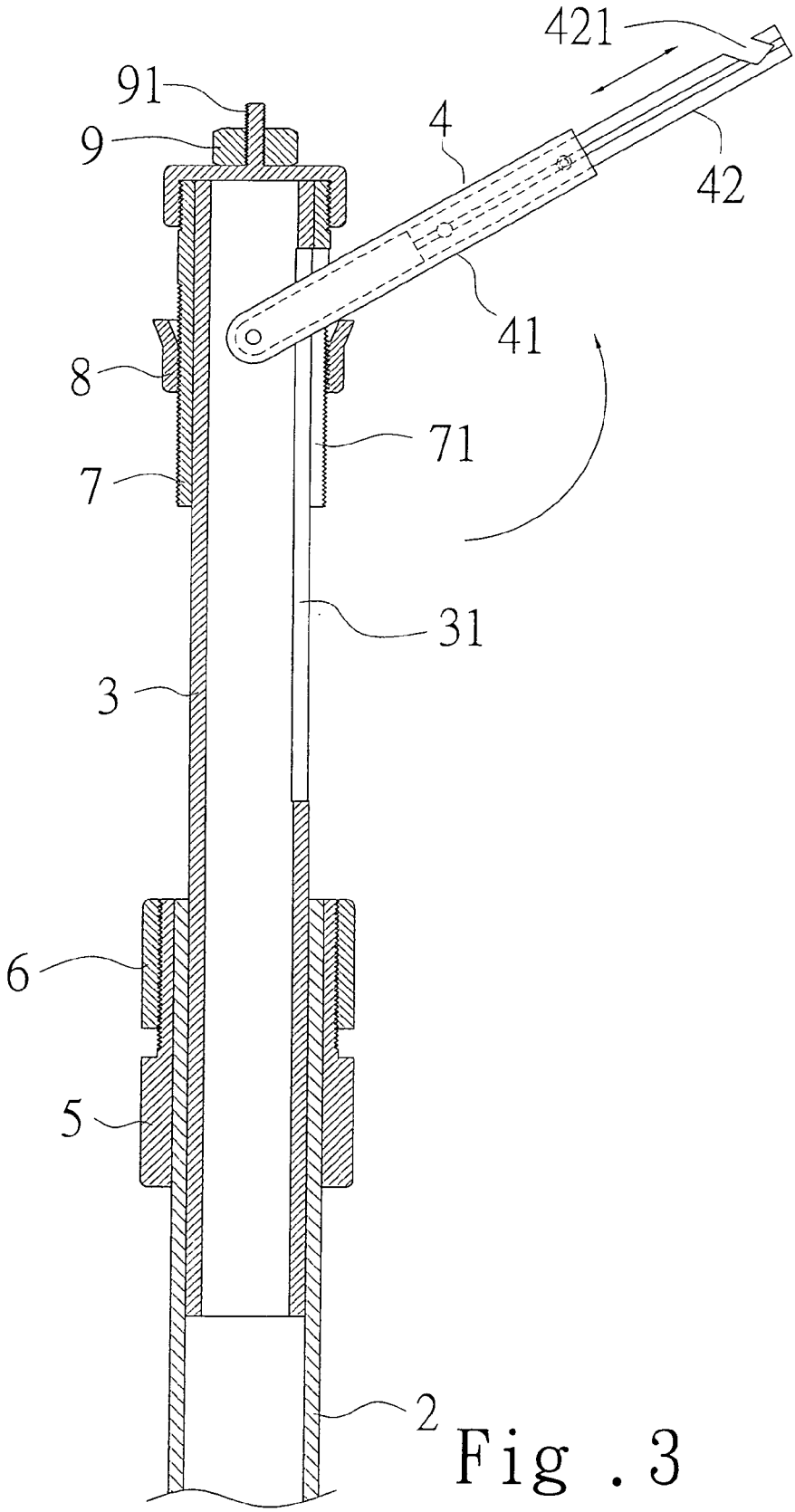
FIG. 3 is another partial cross sectional view of an embodiment according to the present invention.

Refer from FIG. 1 to FIG. 3, a movable multi-directional light stand of the present invention includes: a support base (1), a middle support rod (2), a top support rod (3), a retractable light rod (4), a connection seat (5), a fastening nut (6), a sleeve (7), an adjustment nut (8), and a top head nut (9).

The support base (1) is formed by a plurality of support feet (11), a pivot seat (12), a central support rod (13) and a fastening nut (14). The support feet (11) are pivoted to the pivot seat (12) and the central support rod (13) is assembled with and located onto the pivot seat (12) while the fastening nut (14) is disposed around the central support rod (13). The middle support rod (2) is correspondingly mounted into the central support rod (13). By the fastening nut (14), the middle support rod (2) and the central support rod (13) are assembled and disassembled with each other. The top support rod (3) is a rod that can be retracted into or extended from the middle support rod (2) and is disposed with a mounting slot (31) on a wall thereof, along an axial direction. The retractable light rod (4) consists of a hollow outer tube (41) and an inner tube (42). The inner tube (42) is having a hook (421) and is sliding inside the outer tube (41). One end of the outer tube (41) is in the mounting slot (31), pivoted to the wall of the top support rod (3). A connection seat (5) with an axial through hole is disposed around the middle support rod (2). The upper part of the connection seat (5) is arranged with external threads for fastening. The fastening nut (6) engages the external threads for fastening on the upper part of the connection seat (5) correspondingly. The sleeve (7) is a tube arranged with external threads so as to be disposed around the top of the top support rod (3). A guiding slot (71) corresponding to the mounting slot (31) of the top support rod (3) is arranged at the sleeve (7). The adjustment nut (8) is with threads adapted to engage the external threads of the sleeve (7) so as to support the retractable light rod (4) and locate the retractable light rod (4) in the mounting slot (31). The top head nut (9) is disposed with internal threads corresponding to the external threads of the sleeve (7) for disassembling or securing with each other. A stud (91) that matches one end of the top support rod (3) is arranged on the top of the top head nut (9).

From FIG. 1 to FIG. 7, while adjusting the angle between the retractable light rod (4) and the horizontal plane, the retractable light rod (4) is rotated counterclockwise. The adjustment nut (8) is also rotated to move forward for supporting the outer tube (41) of the retractable light rod (4). Thus one end of the retractable light rod (4) is moved upward and the light hanging on the end thereof is moving away from the ground. When the retractable light rod (4) is rotated clockwise and the adjustment nut (8) is also rotated, the adjustment nut (8) is also rotated to move downward for supporting the outer tube (41) of the retractable light rod (4). And the end of the retractable light rod (4) is moving toward the ground. The height of the light hanging on the end of the retractable light rod (4) is reduced, more close to the ground.

Figure 4:
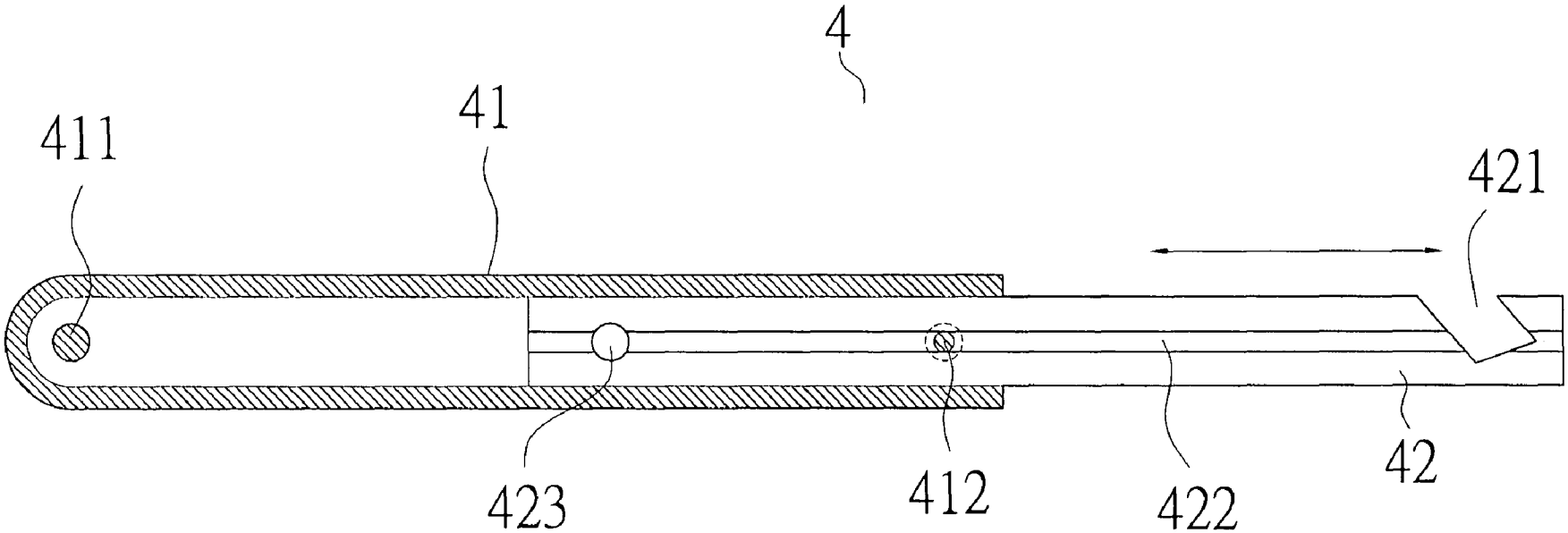
FIG. 4 is a schematic drawing showing operation of a retractable light rod in an embodiment according to the present invention.
Figure 5:
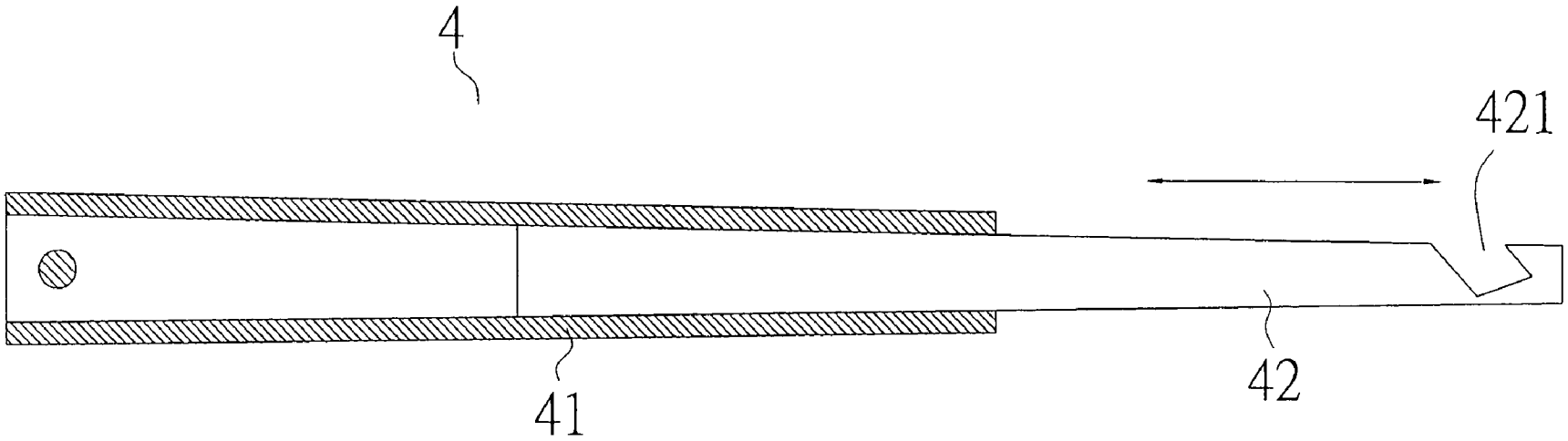
FIG. 5 is a schematic drawing showing operation of a retractable light rod in an embodiment according to the present invention.

Refer to FIGS. 4 & 5, the following shows the adjustment of the length of the retractable light rod (4). A locating hole (411) is disposed on one end of the outer tube (41) while the other end thereof is arranged with a locating pin (412). The inner tube (42) is disposed with a sliding slot (422) for the locating pin (412) of the outer tube (41) to slide therein. On one end of the inner tube (42) mounted into the outer tube (41) correspondingly, a locating pin (423) is arranged at thereof. Thereby, the retractable light rod (4) is fixed on the wall of the top support rod (3) by the locating pin (423) and the locating hole (411) of the outer tube (41). When the inner tube (42) is pulled out slidingly, the locating pin (412) of the outer tube (41) moves along the sliding slot (422) of the inner tube (42). When the locating pin (412) of the outer tube (41) and the locating pin (423) of the inner tube (42) are against each other, the inner tube (42) achieves maximum extension position. The two locating pins (412), (423) are set for length stop.

Moreover, both the outer tube (41) and the inner tube (42) can be designed into a cone-shaped post. By the cone angle, the inner tube (42) presses and leans against the outer tube (41) tightly while being pulled out, as shown in FIG. 5.

Figure 6:
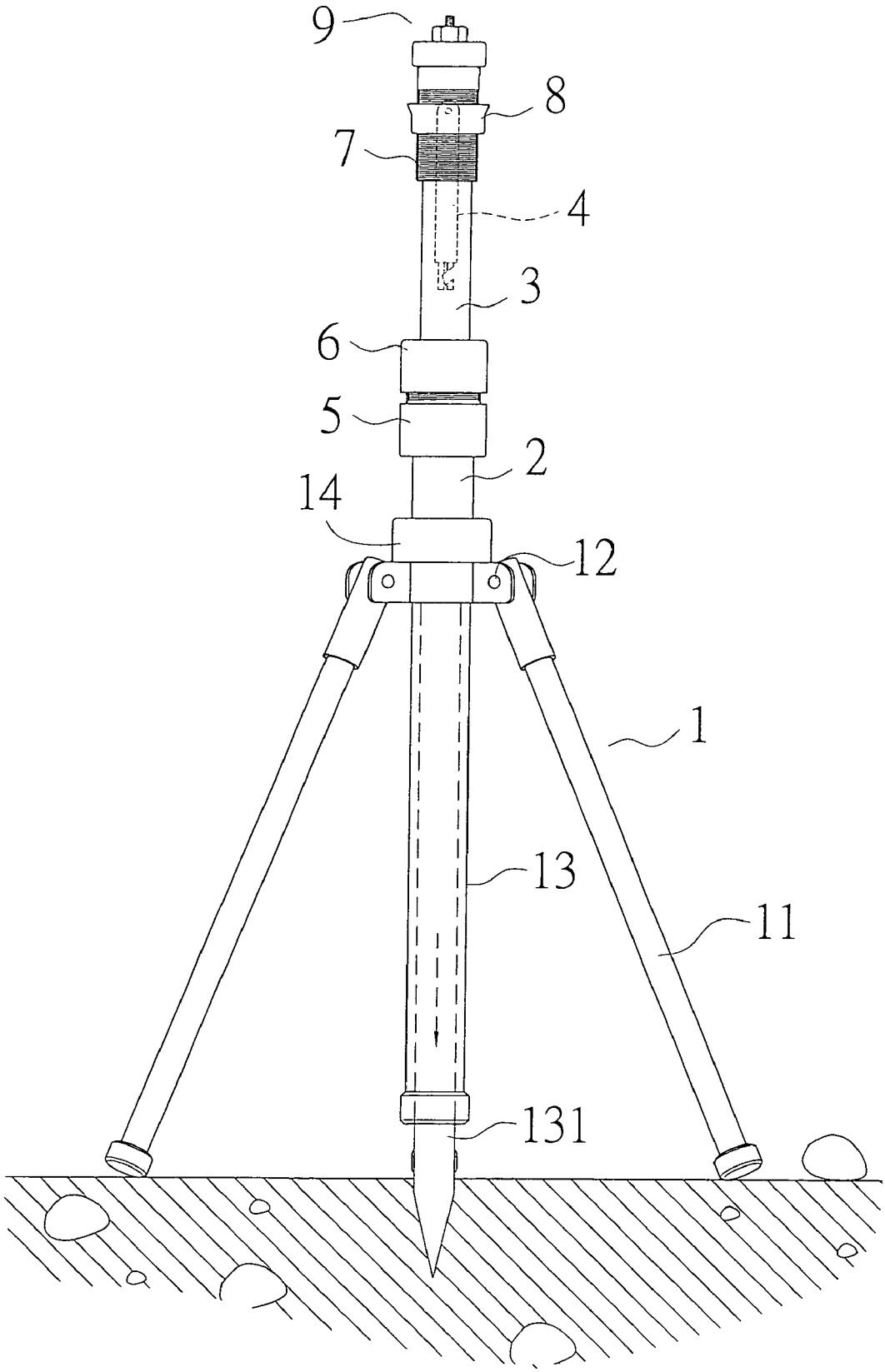
FIG. 6 is a schematic drawing showing operation of an embodiment according to the present invention.
Figure 7:
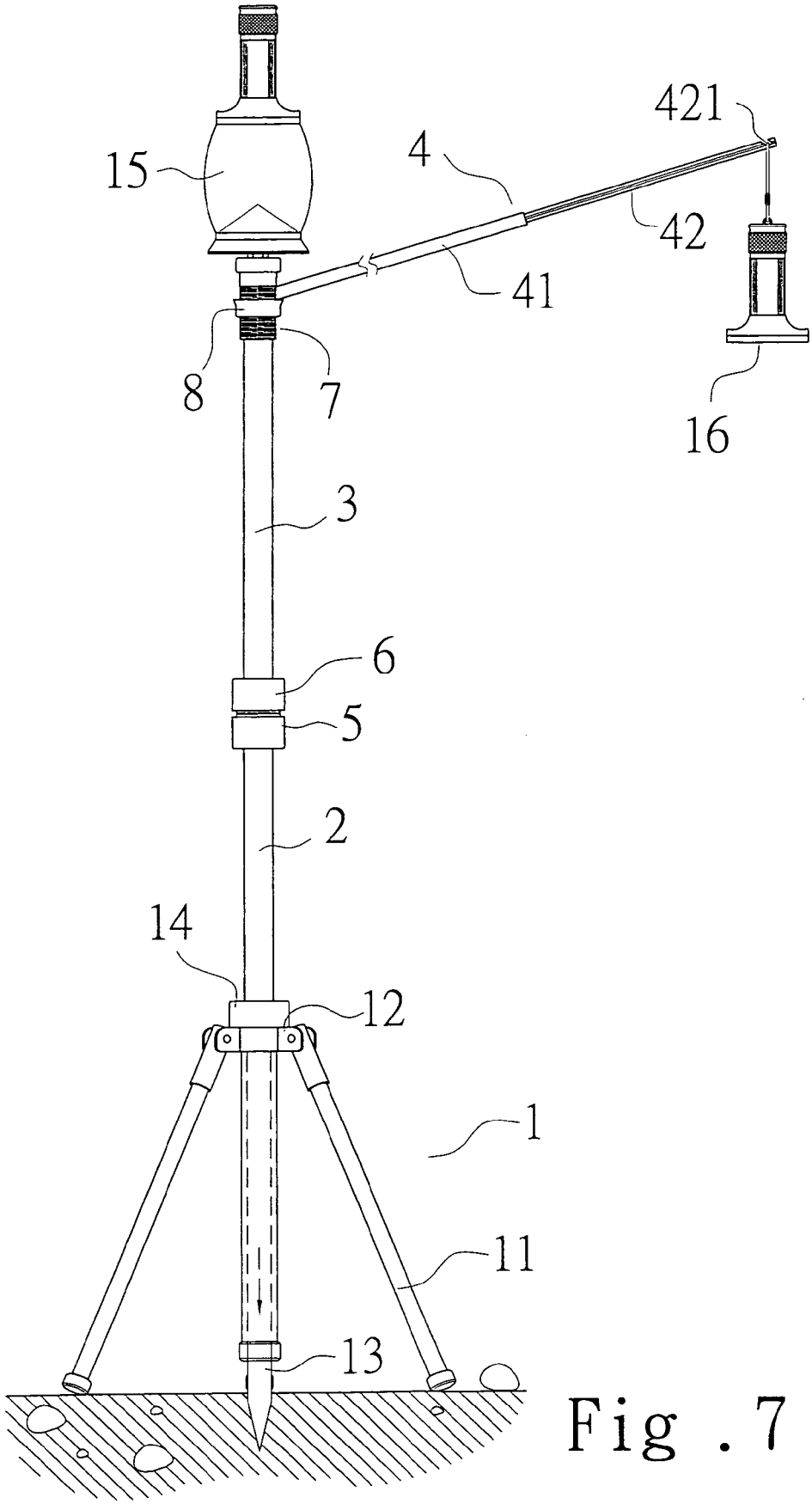
FIG. 7 is a schematic drawing showing operation of an embodiment according to the present invention.

Refer to FIG. 6 and FIG. 7, in use, the support feet (11) is rotated and pulled away from the pivot seat (12) so as to contact the ground. Then rotate the fastening nut (14) and pull the middle support rod (2) out of the central support rod (13). Next rotate the fastening nut (14) tightly for locating the middle support rod (2). While camping outdoors, a locating pin (131) is pulled out of the central support rod (13) and is inserted into the ground. When the device is used indoors, the locating pin (131) is drawn from the central support rod (13). Then loose the fastening nut (6) and pull the top support rod (3) out of the middle support rod (2). Net rotate the fastening nut (6) tightly so as to fix the relative position of the top support rod (3). At last, install a light (15) above the top head nut (9), as shown in FIG. 7.

Figure 8:
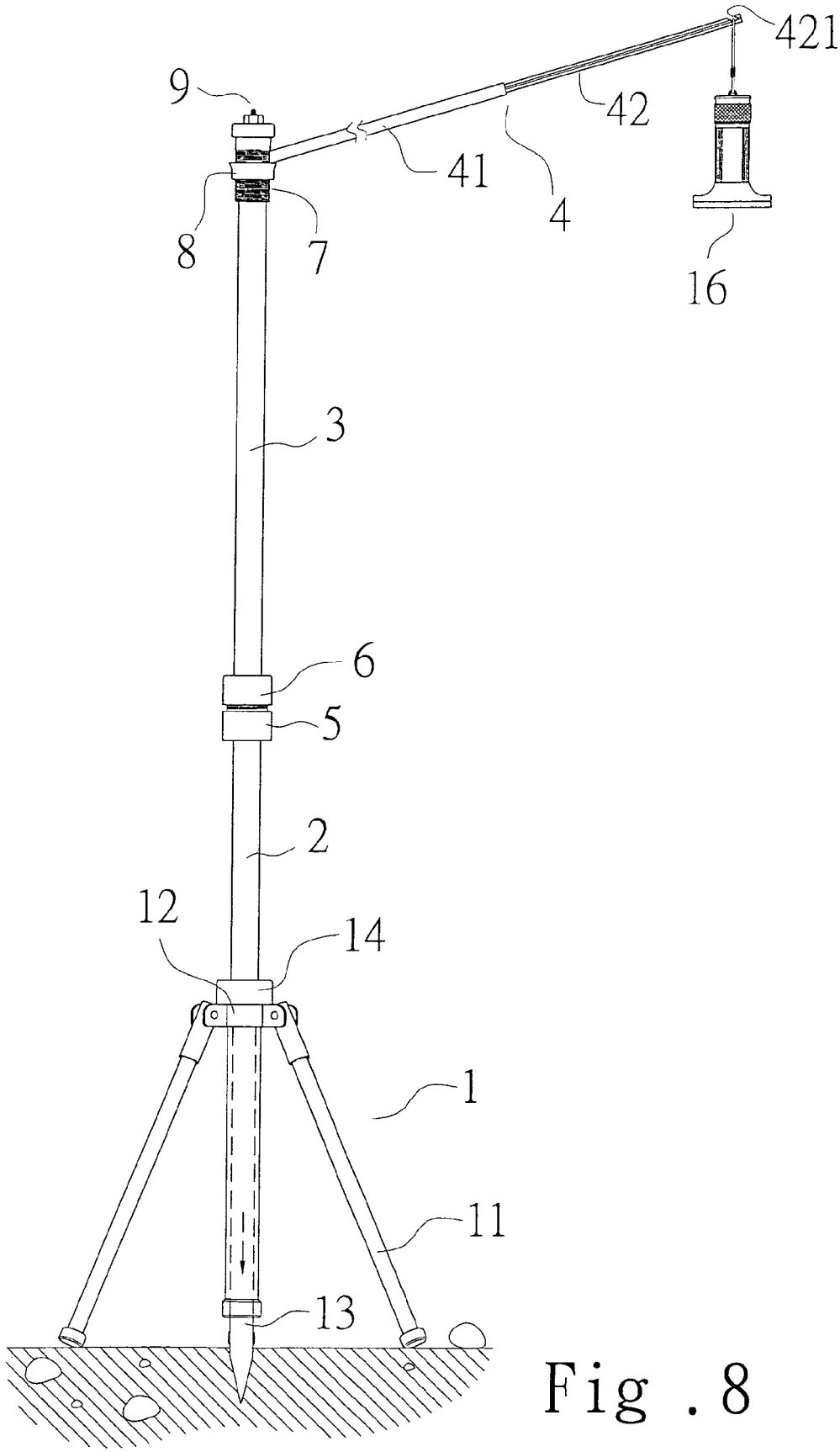
FIG. 8 is a schematic drawing showing operation of an embodiment according to the present invention.
Figure 9:
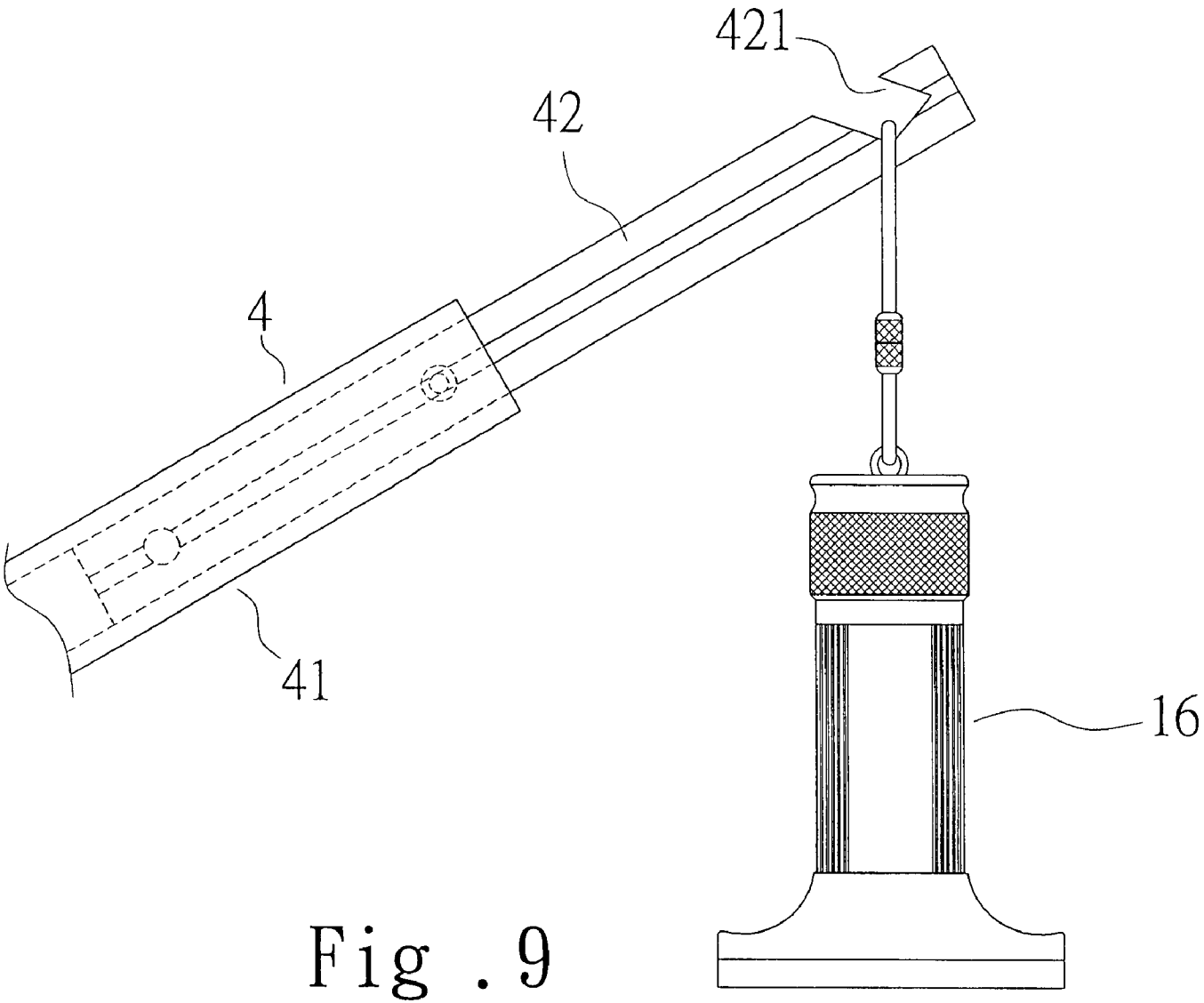
FIG. 9 is a partial enlarged view showing operation of an embodiment according to the present invention.

Refer to FIG. 8 and FIG. 9, rotate the adjustment nut (8) so as to separate from the sleeve (7) and move downwards. Then the retractable light rod (4) is pulled from the mounting slot (31) and is rotating around the top support rod (3). Next the adjustment nut (8) is rotated again to connect with the sleeve (7). Now the adjustment nut (8) supports the retractable light rod (4). The inner tube (42) is drawn from the outer tube (41) and a pendant light (16) is hanging on the hook (421) located on one end of the inner tube (42), as shown in FIG. 8.

Figure 10:
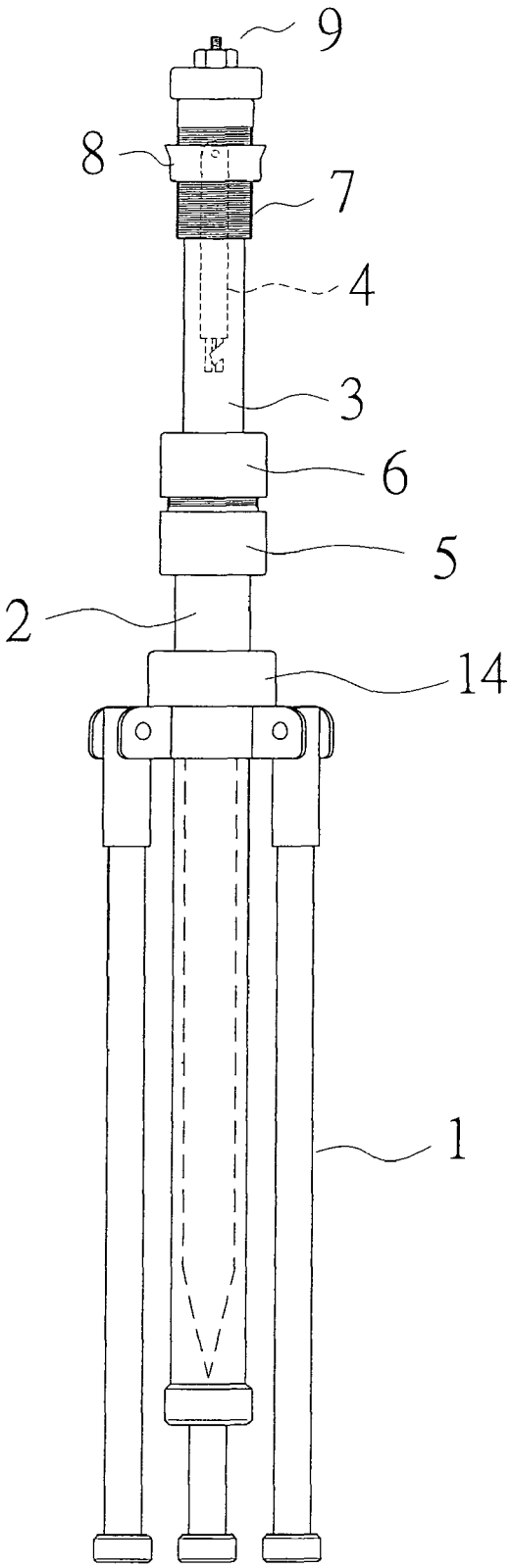
FIG. 10 is a schematic drawing showing an embodiment of the present invention being folded.

Refer to FIG. 10, for storage, the adjustment nut (8) is disassembled with the sleeve (7) and the inner tube (42) is received into the outer tube (41). As shown in FIG. 2, the retractable light rod (4) is rotated clockwise so as to be loaded into the mounting slot (31). The adjustment nut (8) is connected with the sleeve (7) to prevent the retractable light rod (4) from falling out of the mounting slot (31) due to external forces. Then the top support rod (3) is inserted into the middle support rod (2) and the middle support rod (2) is received into the central support rod (13) of the support base (1). At last, the support feet (11) are folded. The folding is finished.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A movable multi-directional light stand comprising:

a middle support rod that is a hollow rod, a top support rod that is retractable and received in the middle support rod and is disposed with a mounting slot on a wall thereof along an axial direction, a retractable light rod having a hollow outer tube and an inner tube that slides in the outer tube and having a hook for supporting a light source while one end of the outer tube is in the mounting slot and pivoted to a wall of the top support rod, a sleeve that is arranged with external threads for being disposed on the top of the top support rod and having a guiding slot corresponding to the mounting slot of the top support rod, and an adjustment nut that engages the external threads of the sleeve so as to support the retractable light rod correspondingly and locate the retractable light rod in the mounting slot.

2. The device as claimed in claim 1, wherein the middle support rod is mounted into a support base formed by a plurality of support feet, a pivot seat, a central support rod and a fastening nut; the support feet are pivoted to the pivot seat and the central support rod is assembled with and located onto the pivot seat while the central support rod and the middle support rod are disassembled and assembled with each other by the fastening nut.

3. The device as claimed in claim 1, wherein a connection seat with an axial through hole is disposed around the middle support rod and an upper part of the connection seat is disposed with external threads for fastening so as to fix the top support rod mounted in the middle support rod together with a fastening nut.

4. The device as claimed in claim 1, wherein a top head nut with internal threads is threaded with the external threads of the sleeve correspondingly and a stud that matches one end of the top support rod is arranged on a top of the top head nut.

5. The device as claimed in claim 1, wherein one end of the outer tube of the retractable light rod is disposed with a locating hole and an other end of the outer tube is arranged with a first locating pin while the inner tube is disposed with a sliding slot for the first locating pin of the outer tube to slide within the sliding slot and a second locating pin is arranged at one end of the inner tube that slides into the outer tube.

6. The device as claimed in claim 1, wherein the outer tube and the inner tube of the retractable light rod are cone-shaped posts.

* * * * *